US007008082B2

(12) United States Patent
Meyer et al.

(10) Patent No.: US 7,008,082 B2
(45) Date of Patent: Mar. 7, 2006

(54) REFLECTOR FOR A LIGHT OF HIGHER POWER WITH AN OUTER SAFETY JACKET

(75) Inventors: Rolf Meyer, Bad Gandersheim (DE); Thomas Kuepper, Bad Gandersheim (DE); Reinhard Henze, Bad Gandersheim (DE); Thomas Wenzel, Muenden (DE)

(73) Assignee: Schott AG, Mainz (DE)

( * ) Notice: Subject to any disclaimer, the term of this patent is extended or adjusted under 35 U.S.C. 154(b) by 187 days.

(21) Appl. No.: 10/671,198

(22) Filed: Sep. 25, 2003

(65) Prior Publication Data

US 2004/0095770 A1 May 20, 2004

(30) Foreign Application Priority Data

Sep. 30, 2002 (DE) ..... 102 45 622

(51) Int. Cl.
*F21V 7/00* (2006.01)

(52) U.S. Cl. ..... 362/344; 313/17; 313/113

(58) Field of Classification Search ..... 313/25, 313/113, 17; 362/267, 516, 519, 296, 344, 362/327, 328, 341, 355–358
See application file for complete search history.

(56) References Cited

U.S. PATENT DOCUMENTS

| | | | | |
|---|---|---|---|---|
| 314,208 | A * | 3/1885 | White | 362/380 |
| 3,148,835 | A * | 9/1964 | Horelick | 362/255 |
| 4,625,140 | A * | 11/1986 | Gagnon | 313/25 |
| 4,721,876 | A * | 1/1988 | White et al. | 313/25 |
| 4,875,766 | A | 10/1989 | Shimodaira et al. | |
| 4,888,517 | A * | 12/1989 | Keeffe et al. | 313/25 |
| 4,942,330 | A * | 7/1990 | Karlotski et al. | 313/25 |
| 5,576,591 | A * | 11/1996 | Block et al. | 313/25 |

FOREIGN PATENT DOCUMENTS

| | | |
|---|---|---|
| DE | 198 37 768 A1 | 3/2000 |
| DE | 100 24 469 A1 | 12/2001 |

OTHER PUBLICATIONS

Sam's and Don's D-Lamp FAQ□□Gas Discharge Lamps, Circuits, Troubleshooting, and Fixtures□□Copyright 1996, 1997, 1998, 1999□□http://members.misty.com/don/dschlamp.html.*

Webster's II New College Dictionary□□1995, Houghton Mifflin Co. □□p. 1278.*

* cited by examiner

*Primary Examiner*—Sandra O'Shea
*Assistant Examiner*—Robert May
(74) *Attorney, Agent, or Firm*—Michael J. Striker

(57) ABSTRACT

The reflector for a light of higher power has a base body made of glass or glass ceramic and a protective jacket provided on the outer surface of the base body. The base body is formed with a receptacle for a light source, especially a gas discharge lamp, and an interior mirror surface for reflecting light. The protective jacket includes a mat or is a mat-shaped body, i.e. a woven or knit textile fabric of natural or synthetic material. Preferably it is a glass-fiber-reinforced mat. In addition to preventing splinters from flying around, the protective jacket advantageously also provides temperature equalization throughout the reflector. It also helps to prevent scattered light. The protective mat or jacket may be attached to the base body with an adhesive, such as a water glass.

20 Claims, 1 Drawing Sheet

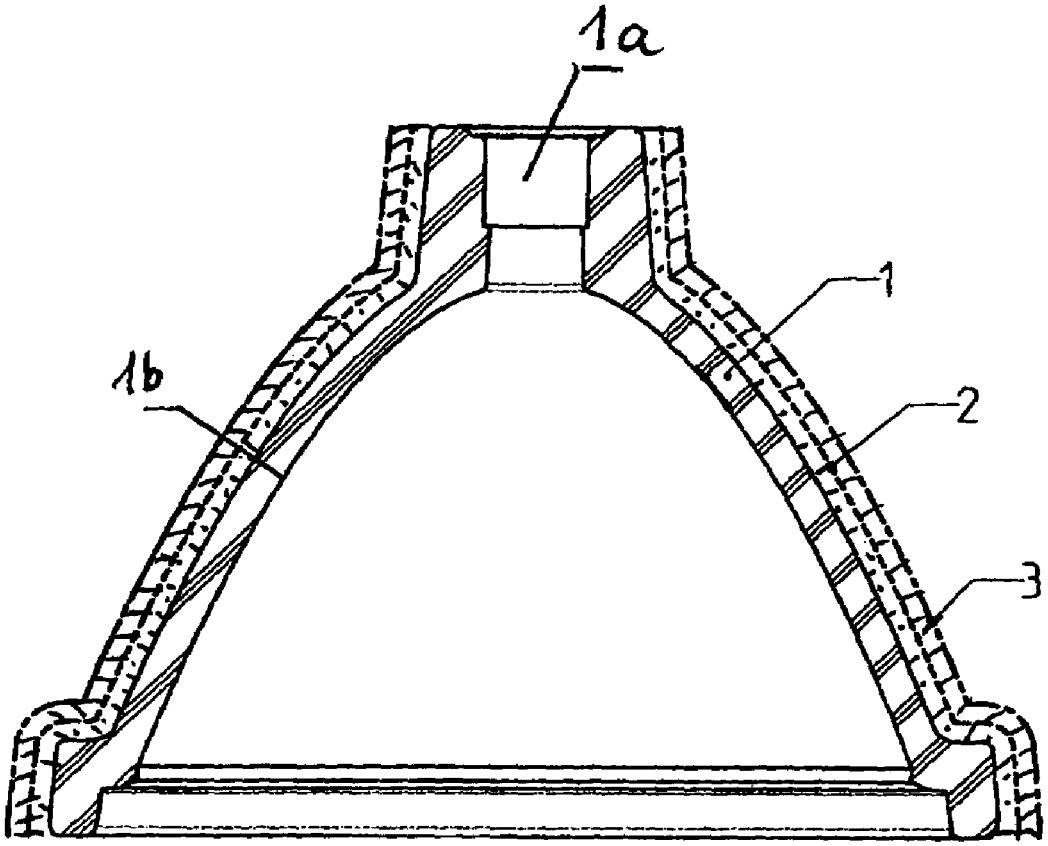
1a
1
1b
2
3

REFLECTOR FOR A LIGHT OF HIGHER POWER WITH AN OUTER SAFETY JACKET

BACKGROUND OF THE INVENTION

1. Field of the Invention

The present invention relates to a reflector for lights of higher power, which comprises a base body made of glass or glass ceramic, which has a receptacle for a lamp, preferably a high pressure gas discharge lamp, an interior mirror surface and an outer surface provided with a jacket.

2. Description of the Related Art

The term "light" means a device for receiving and for operating a commercial light source (gas discharge lamp, light bulb, etc) for the purposes of the present invention. The present invention generally concerns those lights, which have an optical reflector to provide the desired distribution of light, such as lights in the home, lights for supplying light to a light guide, auto headlights, projectors, etc. This sort of reflector generally has an elliptical, parabolic or conical section basic shape. It can contain glass or glass ceramic as a substrate. Typically it has a so-called cold light mirror, with which the visible radiation of the built in lamp is reflected and through which the IR radiation passes. The reflector thus has a colored residual exterior transmission, usually blue, but also red, green or other colors.

This sort of reflector is widely used by the lighting industry, especially in freely hanging halogen lights for room illumination. The associated lamps have a comparatively lower electrical power, in a range of 10 to 60 watts.

However there are also lighting units with reflectors, which require light sources with higher electrical power, for example digital projectors, so-called beamers, headlights, etc. The power of these lighting units is in a range of 200 to 400 watts. Light sources or lamps for these lighting units with reflectors are typically gas discharge lamps. They have a high interior pressure of up to $2\times10^5$ hPa. They have numerous technological advantages however their service life is limited by thermochemical influences. Generally the service life of these lamps is of the order of 2000 hours.

The present invention especially concerns reflectors for this sort of light of higher power.

A serious disadvantage of these gas discharge lamps is that at the end of their service life an explosion destroys them. This explosion seriously damages the reflector, produces flying glass splinters and pieces and causes considerable damage. This explosion also can damage valuable optical components and parts of associated equipment.

To avoid glass splinter formation reflectors are made with greater wall thickness. Their wall thickness is more than 4 mm. However thermal expansion of these reflectors again leads to breakage because of the high heat load. Increasing the reflector wall thickness is thus not a satisfactory solution.

There is an additional problem. In order to mask or screen scattered light from the reflector, commercially obtained reflectors are surrounded by a housing, which has aeration slots for heat dissipation, from which light issues, which can be troublesome. In order to keep the aeration slots small, fans must be already provided. Noise generation is associated with the operation of these fans.

A reflector for a high pressure gas discharge lamp is known from DE 100 24 469 A1, which has explosion protection means and a light protector, so that no housing with aeration slots and only a reduced cooling by fans are required.

The known reflector has a protective jacket around its exterior circumference, which comprises a coating of heat-resistant viscous plastic, preferably a fluoro-polymer, which can be formed for deflecting light, which occurs typically by additional application of an lacquer layer.

It has been shown that the plastic coating does not guarantee explosion and splinter protection, since tears or fractions are formed because of great thermal load and larger splinters that can arise during explosion of the high-pressure gas discharge lamp. Furthermore a second coating is necessary in practice, in order to guarantee light protection.

SUMMARY OF THE INVENTION

It is an object of the present invention to provide a reflector for lights of higher power, which is based on a reflector with an outer jacket, in which the jacket is formed so that reliable burst protection is guaranteed, which means that the reflector remains mechanically stable during explosive destruction of the lamp held in the reflector.

It is another object of the present invention to provide a reflector for lights of higher power, based on a reflector with an outer jacket, in which the jacket is formed so that light protection and temperature compensation are provided in a simple manner.

These objects and others which will be made more apparent hereinafter are attained with a reflector for a light of higher power, which comprises a base body made of glass or glass ceramic, which has a receptacle for a light source, such as a discharge lamp, a mirrored interior surface and an outer surface; and a jacket surrounding the outer surface.

According to the invention the jacket around the outer surface is mat-like or mat-shaped or is a mat.

The jacket mat according to the invention is tear resistant to a large extent and guarantees a reliable burst protection, which fulfills the basic function of the protective jacket. It furthermore provides light protection at the same time.

Additionally the jacket causes a uniform temperature distribution to exist in the reflector, so that thermo-mechanical stresses in the reflector are avoided. Because of that glass, which can withstand only small loads due to thermo-mechanical stresses, is advantageously used. This has the result that a highly heat-resistant glass, which is more economical than glass ceramic, can be used at application temperatures up to 600° C. Especially glass marketed under the trademark DURAN® can be used as the heat-resistant glass. This sort of glass is temperature-stable up to 600° C. without loading with thermo-mechanical stresses, while the temperature-resistance of glass ceramic is at 700° C. to 800° C. Loading with thermo-mechanical stresses starts at a temperature of 350° C.

The term "mat" according Brockhaus Encyclopedia 19th Edition, means a braided or interlaced natural or chemical fibrous material and/or wire. The meaning of "mat" in the appended claims is limited to this technical meaning and should not be construed to be broader for any purpose within the context of the present invention.

In the case of the present invention glass-fiber- or carbon-fiber-reinforced textile fibers or ceramic fibers can be used, which are IR permeable so that the cold light effect of the reflector is not impaired.

The jacket must not necessarily be a woven or knit mat. The mat-like jacket can also be a fleece from glass or carbon fibers or ceramic fibers. Furthermore the jacket can comprise a pressed jacket-like body from inorganic mineral material, which is very heat or temperature-resistant.

Preferably the jacket is glued to the outer surface of the reflector, for example with water glass as an adhesive.

It can however be formed as a separate hood-shaped body, which is placed on the outside of the reflector.

Additional advantageous embodiments of the reflector according to the invention are described hereinbelow and in the dependent claims.

For example, the jacket can be colored or made from a hardened substance. It can be provided with an outer organic coating, especially a lacquer or varnish layer. The organic coating may comprise a fluoro-polymer.

BRIEF DESCRIPTION OF THE DRAWING

The objects, features and advantages of the invention will now be illustrated in more detail with the aid of the following description of the preferred embodiments, with reference to the sole FIGURE, which is a schematic longitudinal cross-sectional view through a reflector for a light of higher power according to the invention.

DETAILED DESCRIPTION OF THE INVENTION

The single FIGURE is a longitudinal section through a reflector for a light comprising a base body 1 made of glass or glass ceramic, which has a typically parabolic shape with a interior mirror surface 1*b*. This reflector is equipped with a light source of higher power, typically with a high-pressure gas discharge light source as the lamp (not shown). The light source is arranged in a receptacle 1*a* of the base body 1.

As stated above, at the end of the service life of this sort of lamp it is destroyed by an interior explosion, which damages the base body, with the result that glass splinters of the base body fly around. These splinters are a considerable danger and can damage important optical components and parts of the apparatus.

In order to prevent glass splinters produced by destruction of the base body 1 of the reflector from reaching various equipment, a jacket in the form of a glass-mat protective jacket 3 is put on the outer surface of the base body 1. The protective jacket 3 is attached to the base body 1 by means of an adhesive layer 2 of highly heat-resistant adhesive.

This glass-mat protective jacket 3 prevents parts of the base body from flying around when the base body is destroyed.

Furthermore the glass mat coating is advantageous for the structure. The cooling of the lamp by masking scattered light can be changed so that the interfering noise generation can clearly be reduced. Furthermore the glass mat protective jacket acts at the same time as a light protector, so that the residual light shinning through the aeration slots can be reduced. Furthermore the glass mat protective jacket causes a temperature balancing throughout the reflector, so that the cooling speed is considerably changed during turn-on and turn-off. Use in a high temperature range up to 800° C. is permitted.

The mat of the protective jacket 3 preferably comprises a woven and/or a knit textile made from glass-fiber reinforced or carbon-fiber reinforced thread or yarn, for example as known from repair kits with hardenable resin. This sort of glass mat is mechanically very stable and also absorbs other substances.

The protective jacket 3 can also be made from another material, for example from a woven and/or a knit textile with ceramic fibers, as well from a fleece of glass and/or carbon fibers or ceramic fibers.

Also a mat of metal fibers is conceivable in principle. Then the IR radiation of the lamps from the metallic mat is reflected while the IR radiation passes through the mat made of glass or carbon fibers and/or ceramic fibers. In this embodiment a desirable cold light effect remains in spite of the protective jacket.

Furthermore pressed mats from inorganic mineral materials, such as mica, siliceous earth, etc are conceivable.

Water glass is suitable, for example, as the adhesive. Also other adhesives, such as physically bonding adhesives, such as silica sols, water glass formulations or water-soluble aluminates, or chemically hardenable adhesives, e.g. based on phosphorous or phosphoric acids are usable.

So that the mat of the jacket 3 spreads sufficiently well on the outer contour of the glass/glass ceramic base body and solidifies sufficiently well, it is saturated with a hardenable solution, for example with a fluoropolymer (TEFLON®) or with a colloidal silicic acid.

It is also conceivable to coat the mat 3 with a high temperature varnish or lacquer.

Furthermore it can be advantageous to make the coating mat colored, e.g. since the fibers of the mat are coated prior to or after forming with a colored pigment, or otherwise colored in a known manner, e.g. by saturation with a pigment or paint.

When the reflector of the invention is used advantageously with a high-pressure gas discharge lamp, i.e. the protective features of the jacket are of primary significance. However it can also be used with a reflector equipped with other lamps, especially when the light protective or temperature balancing features of the mat are more significant.

The disclosure in German Patent Application 102 45 622.4-23 of Sep. 30, 2002 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a reflector with an outer jacket for lights of higher power, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A reflector for lights of higher power, said reflector comprising a base body made of glass or glass ceramic, wherein said base body is formed with a receptacle for a light source and said base body has an interior mirror surface and ar outer surface; and a protective jacket provided on the outer surface of the base body, wherein said protective jacket comprises a mat, and said mat is formed to mask or screen scattered light from the reflector and to provide a uniform temperature distribution in the reflector to avoid thermo-mechanical stresses as well as to protect from explosive destruction of the light source.

2. The reflector as defined in claim 1, wherein the protective jacket consists of said mat and said mat comprises a glass-fiber reinforced textile fabric.

3. The reflector as defined in claim 1, wherein the protective jacket consists of said mat and said mat comprises a carbon-fiber reinforced textile fabric.

4. The reflector as defined in claim 1, wherein the protective jacket consists of said mat and said mat comprises ceramic fibers.

5. The reflector as defined in claim 1, wherein the protective jacket consists of said mat and said mat comprises metal fibers.

6. The reflector as defined in claim 1, wherein the protective jacket consists of a fleece of glass fibers, carbon fibers or ceramic fibers.

7. The reflector as defined in claim 1, wherein the protective jacket consists of a pressed mat-shaped body and said mat-shaped body comprises an inorganic mineral material.

8. The reflector as defined in claim 1, wherein the protective jacket is g ued to the outer surface of the base body with an adhesive.

9. The reflector as defined in claim 8, wherein said adhesive is a water glass.

10. The reflector as defined in claim 1, wherein the protective jacket consists of a separate hood-shaped body, which is placed on the outside of the reflector.

11. The reflector as defined in claim 1, wherein the protective jacket is colored.

12. The reflector as defined in claim 1, wherein the protective jacket is saturated with a hardenable substance.

13. The reflector as defined in claim 1, wherein the protective jacket is provided with an outer organic coating.

14. The reflector as defined in claim 13, wherein the organic coating is a lacquer or varnish layer.

15. The reflector as defined in claim 13, wherein the organic coating is a fluoropolymer layer.

16. The reflector as defined in claim 1, wherein said light source is a gas discharge lamp.

17. The reflector as defined in claim 1, wherein the base body has a parabolic shape.

18. A reflector for lights of higher power, said reflector comprising a base body made of glass or glass ceramic, wherein said base body is formed with a receptacle for a high-pressure gas discharge light source and said base body has an interior mirror surface and an outer surface; and a protective jacket provided on the outer surface of the base body, wherein said protective jacket comprises a mat and said mat is formed to screen scattered light, to prevent thermo-mechanical stresses and to protect from explosive destruction of the light source.

19. The reflector as defined in claim 18, wherein the protective jacket is glued to the outer surface of the base body with an adhesive.

20. The reflector as defined in claim 18, wherein the protective jacket consists of a separate hood-shaped body, which is placed on the outside of the reflector.

* * * * *